US010232918B2

(12) United States Patent
Curnutte et al.

(10) Patent No.: US 10,232,918 B2
(45) **Date of Patent: *Mar. 19, 2019**

(54) BOARD CARRIER

(71) Applicant: TOWNES & CO. LLC, Laguna Beach, CA (US)

(72) Inventors: Paul Curnutte, Laguna Beach, CA (US); Jeremy Katz, Laguna Beach, CA (US)

(73) Assignee: TOWNES & CO. LLC

( * ) Notice: Subject to any disclaimer, the term of this patent is extended or adjusted under 35 U.S.C. 154(b) by 0 days.

This patent is subject to a terminal disclaimer.

(21) Appl. No.: 15/607,385

(22) Filed: May 26, 2017

(65) Prior Publication Data

US 2017/0259891 A1 Sep. 14, 2017

Related U.S. Application Data

(63) Continuation-in-part of application No. 14/603,339, filed on Jan. 22, 2015, now Pat. No. 9,663,199.

(51) Int. Cl.

| | |
|---|---|
| ***A45F 3/02*** | (2006.01) |
| ***B63B 35/79*** | (2006.01) |
| ***A45F 5/02*** | (2006.01) |
| ***A45F 3/14*** | (2006.01) |

(52) U.S. Cl.
CPC ..... *B63B 35/7946* (2013.01); *A45F 3/14* (2013.01); *A45F 5/021* (2013.01); *A45F 2003/144* (2013.01)

(58) Field of Classification Search
CPC ..... A45F 5/021; A45F 3/15; B63B 35/7946
USPC ..... 224/268–270, 257, 917
See application file for complete search history.

(56) References Cited

U.S. PATENT DOCUMENTS

| | | | |
|---|---|---|---|
| 603,538 | A | 5/1898 | Pettibone |
| 2,651,441 | A | 9/1953 | Rau et al. |
| 3,168,971 | A | 2/1965 | Goertzen |
| 3,377,007 | A | 4/1968 | Gayler et al. |
| 4,699,415 | A | 10/1987 | Skovajsa |
| 4,724,989 | A | 2/1988 | Silberberg |
| 4,804,025 | A | 2/1989 | Bear |
| D321,792 | S | 11/1991 | MacNeary |

(Continued)

FOREIGN PATENT DOCUMENTS

| | | |
|---|---|---|
| AU | 2010101367 | 6/2011 |
| FR | 2913891 | 9/2008 |

(Continued)

OTHER PUBLICATIONS

Jul. 9, 2018 Office Action Issued by European Patent Office in Applicant's European Application No. 16740853.

(Continued)

*Primary Examiner* — Adam J Waggenspack
(74) *Attorney, Agent, or Firm* — The Myers Law Group

(57) ABSTRACT

A board carrier uses a belt configured for wearing around a person's waist. A hook bag in the belt has a downwardly facing entry with a closure. Proximal and distal ends of the hook are joined to the belt by length adjustable straps. The board is positioned within the hook with three-points of mutual contact between the board and the interior of the hook. The hook may have a spring clamp for securing a paddle. When not in use the hook and straps are placed within the hook bag.

9 Claims, 14 Drawing Sheets

(56) References Cited

U.S. PATENT DOCUMENTS

| | | | | |
|---|---|---|---|---|
| 5,158,510 | A | 10/1992 | Lemire | |
| 5,361,954 | A | 11/1994 | Tura | |
| 5,490,618 | A | 2/1996 | Davidson | |
| 5,582,338 | A | 12/1996 | Tamura | |
| 6,086,102 | A | 7/2000 | Stark et al. | |
| 6,857,673 | B2 * | 2/2005 | Lang | B65G 7/12 294/142 |
| 7,175,061 | B2 | 2/2007 | Dohn | |
| 7,543,726 | B2 * | 6/2009 | MacNaughton | A45F 5/02 224/268 |
| 7,942,294 | B2 | 5/2011 | Burton | |
| D640,052 | S | 6/2011 | Benson | |
| 2003/0164391 | A1 | 9/2003 | Zwagerman | |
| 2004/0056060 | A1 | 3/2004 | Iannini | |
| 2005/0184118 | A1 * | 8/2005 | Vella | A45F 3/02 224/625 |
| 2006/0270290 | A1 * | 11/2006 | Tellew | B63C 9/155 441/88 |
| 2008/0016658 | A1 | 1/2008 | Kutny Splaine | |
| 2008/0057804 | A1 | 3/2008 | Watanabe | |
| 2008/0185409 | A1 | 8/2008 | Kellenberger | |
| 2009/0090754 | A1 | 4/2009 | Haberlein | |
| 2010/0187274 | A1 | 7/2010 | Chock, Jr. | |

FOREIGN PATENT DOCUMENTS

| | | |
|---|---|---|
| KR | 20140046793 | 4/2014 |
| WO | WO2007058552 | 5/2007 |

OTHER PUBLICATIONS

International Search Report for PCT/US2016/014567 dated Jun. 21, 2016.

SupN'Go. Datasheet [online]. SurfStow.com, 2014; <URL: http://web.archive.org/web/20141026023828/http://surfstow.com/transport.html> [See Enclosed PCT Search Report].

Economical SUP Storage Rack with Paddle Holder. Datasheet [online]. StoreYourBoard.com, 2012. <URL: http://blog.storeyourboard.com/2012/03/economical-sup-storage-rack-with-pa.

ACK Product Focus: Seattle Sports SupStow Bag. YouTube [online]. Austin Kayak, 2014. <URL: https://www.youtube.com/watch?v=MtMmjXdn-y4> [See Enclosed PCT Search Report].

* cited by examiner

BOARD CARRIER

PRIORITY CLAIM

This applications claims the priority date of non-provisional application Ser. No. 14/603,339 filed on Jan. 22, 2015, which is herein incorporated by reference in its entirety.

BACKGROUND

The herein disclosed subject matter relates to the field of personally worn carriers and particularly to such carriers for surfboards, paddleboards, and the like.

For personally carrying ungainly or heavy objects, strap secured hooks are known as in U.S. Pat. No. 603,538 to Pettibone, U.S. Pat. No. 2,651,441 to Rau et al, U.S. Pat. No. 4,699,415 to Skovajsa, U.S. Pat. No. 5,361,954 to Tura, U.S. Pat. No. 5,490,618 to Davidson, U.S. Pat. No. 5,582,338 to Tamura, U.S. Pat. No. 7,543,726 to MacNaughton, US 2010/0187274 to Chock, Jr., Des. 321792 to MacNeary, and WO 2007/058552 to Winter; as well as sling mounts as in U.S. Pat. No. 3,377,007 to Gayler Jr., FR 2913891 to Cavallini, U.S. Pat. No. 4,804,025 to Bear, US 2004/0056060 to Iannini et al, US 2009/0090754 to Haberlein, and U.S. Pat. No. 4,724,989 to Silberberg. These devices are fastened by straps and harnesses to a person by waist, shoulder, chest, bandoleer, and various combinations of such connecting gear in order to distribute weight, free the hands, and provide other benefits of convenience and necessity. However, what is needed and not found in the prior art is a personal carrier for a paddleboard or surfboard that is quick and easy to position for use yet is easy to store conveniently when not in use, and will support an object of significant weight and size for portage. The presently described apparatus distinguishes over the prior art in a novel manner and fulfills this need.

SUMMARY

The following detailed description includes references to the accompanying illustrations which form a part of the detailed description. When carrying a board to and from a body of water: lake, ocean, or river, its weight and size requires a specialized carrier system to enable just one person to handle this task. In breezy conditions such as at the beach, the large surface area of a board may cause it to catch the wind and, again, be difficult to handle without a specialized carrier system, and, after dismounting the board from its carrier it is desirable to stow the carrier system on the person so that it doesn't interfere with riding the board. In summary, the carrier system should therefore be lightweight, relatively compact, easily stowed and inexpensive to manufacture. Example embodiments of the specialized carrier system are described herein in enough detail to enable those skilled in the art to practice the presented subject matter. However, once familiar with this disclosure it will be apparent to one of ordinary skill in the art that the present apparatus may be practiced without some of the presented specific details. In other instances, well-known methods, procedures and components may not be described in detail so as not to unnecessarily obscure aspects of the embodiments. The embodiments can be combined, other embodiments can be utilized or structural and logical changes can be made without departing from the scope of what is defined and claimed. The following detailed description is, therefore, not to be taken in a limiting sense, as the scope is defined by the appended claims and their equivalents which are to be understood in their broadest possible sense.

In this document, the terms "a" or "an" are used, as is common in patent documents, to include one or more than one. Furthermore, the term "or" is used to refer to a nonexclusive "or," such that "A or B" includes "A but not B," "B but not A," and "A and B," unless otherwise indicated.

BRIEF DESCRIPTION OF THE DRAWINGS

Embodiments of the described apparatus are illustrated by way of example in the figures of the accompanying drawing sheets, in which like references indicate the same or similar elements shown and in which.

DETAILED DESCRIPTION

Disclosed in FIGS. 1A, 1B, and 2-6 are aspects of a board carrier, herein "carrier 10." As discussed previously carrier 10 is an advanced apparatus for manually carrying a board 20, and is especially useful for porting a paddleboard and paddle, or a stand-up surfboard known as a longboard. Today such boards 20 may have a medial width of from about 26 to 36 inches, and an overall length of up to 14 feet. The medial thickness of board 20 may be between about 3 and 8 inches and may weigh between about 10 and 25 pounds. Boards 20 are typically transported to water locations by vehicles and then carried or ported to and from the water's edge manually. Such an object is difficult to carry any significant distance or over rough terrain or steep grades due to its weight, and size. When breezes are present a manually carried board 20 may be difficult to handle due to wind forces on their surface areas especially when held vertically; see FIG. 1.

Figure 1A:
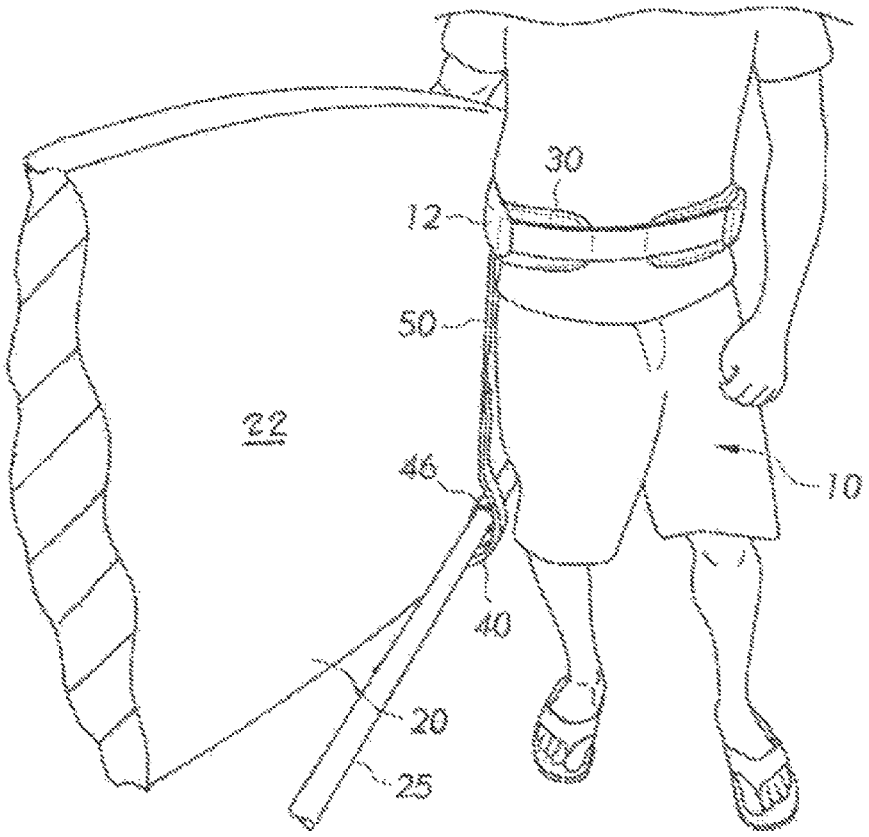
FIG. 1A is a front perspective view of board and paddle as mounted in a board carrier for porting.
Figure 1B:
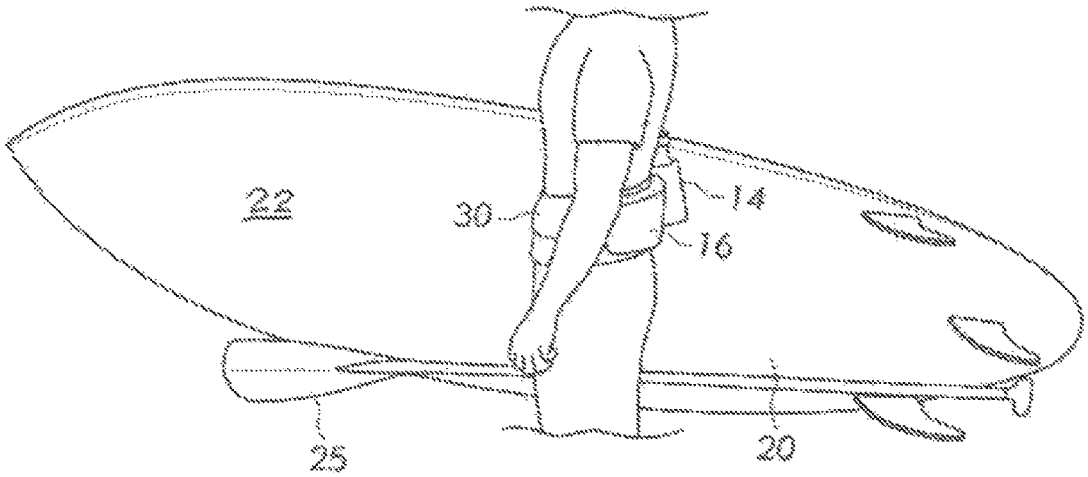
FIG. 1B is right side view thereof.
Figure 2:
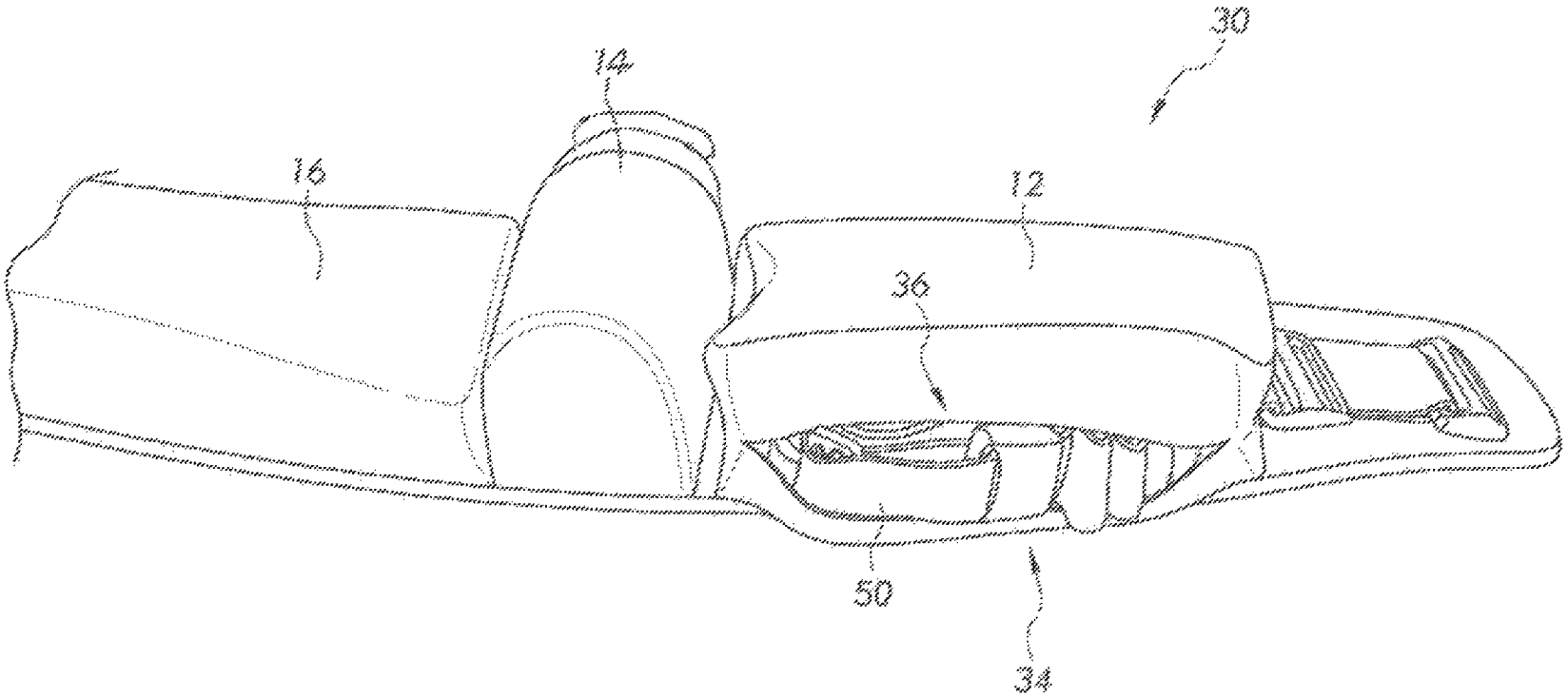
FIG. 2 is a partial bottom perspective view of a belt thereof.

As shown in FIGS. 1A and 1B, carrier 10 may include a belt 30 of Cordura® or similar fabric sewn around a molded foam portion and may have a nylon backing, whereas this construction provides strength, durability and comfort. A hook bag 12, water bottle holder 14 and gear bag 16 or other pockets or pouches may be attached to belt 30 and may be made of ripstop nylon or similar material for flexibility and durability.

Configured for wearing around the waist of a paddle boarder, or surfboard rider belt 30 is to be worn around the waist as shown in FIGS. 1A and 1B. Belt-hook bag 12 may be in the form of a pouch, see FIG. 2, with a downwardly facing entry 34 including a closure 36 such as a zipper, Velcro® strips, spring mounted flaps, or otherwise.

Figure 3:
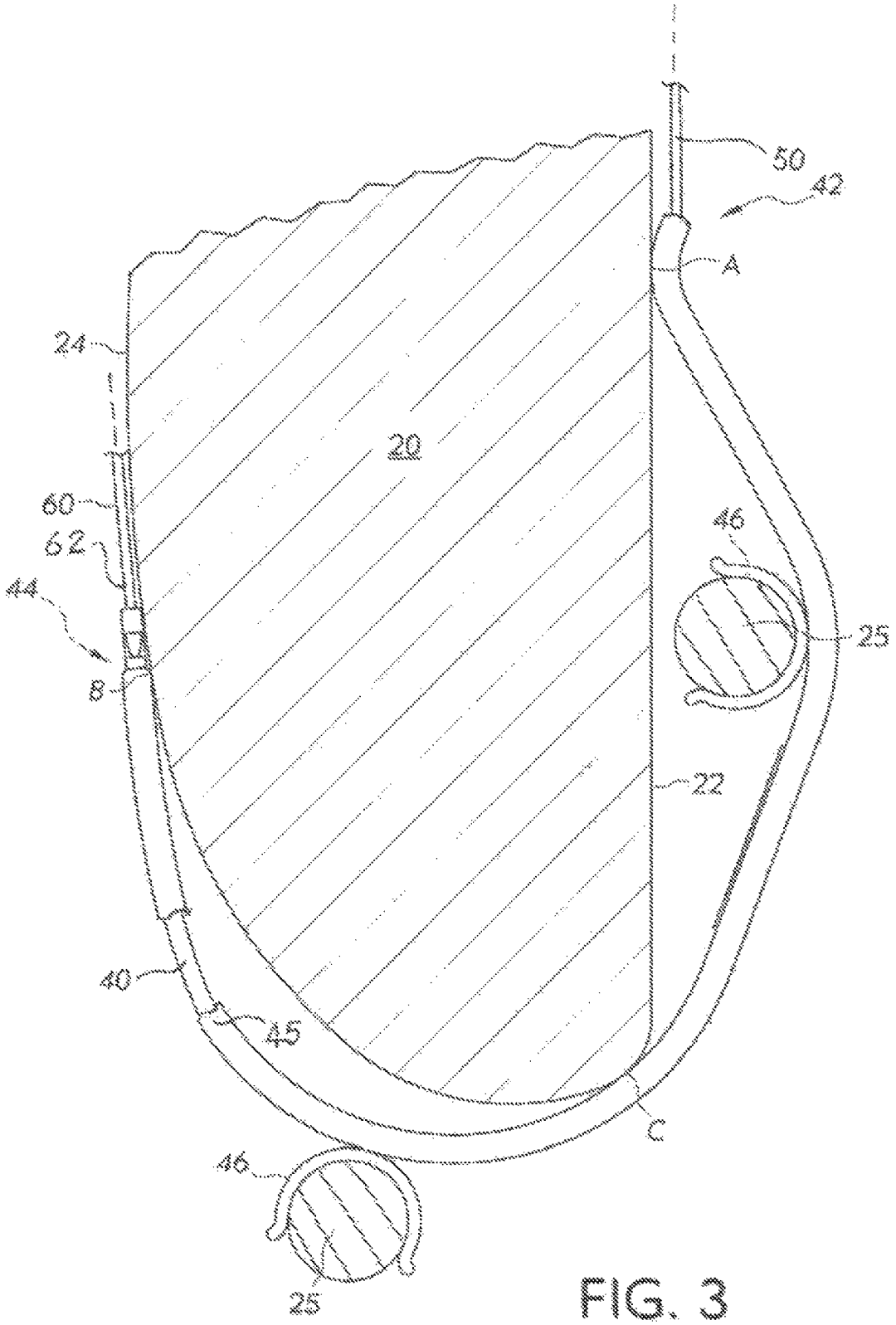
FIG. 3 is an elevation view of a hook thereof showing a portion of a board as inserted therein with proximal and distal straps supporting the hook and showing paddles clamped to the hook.
Figure 4:
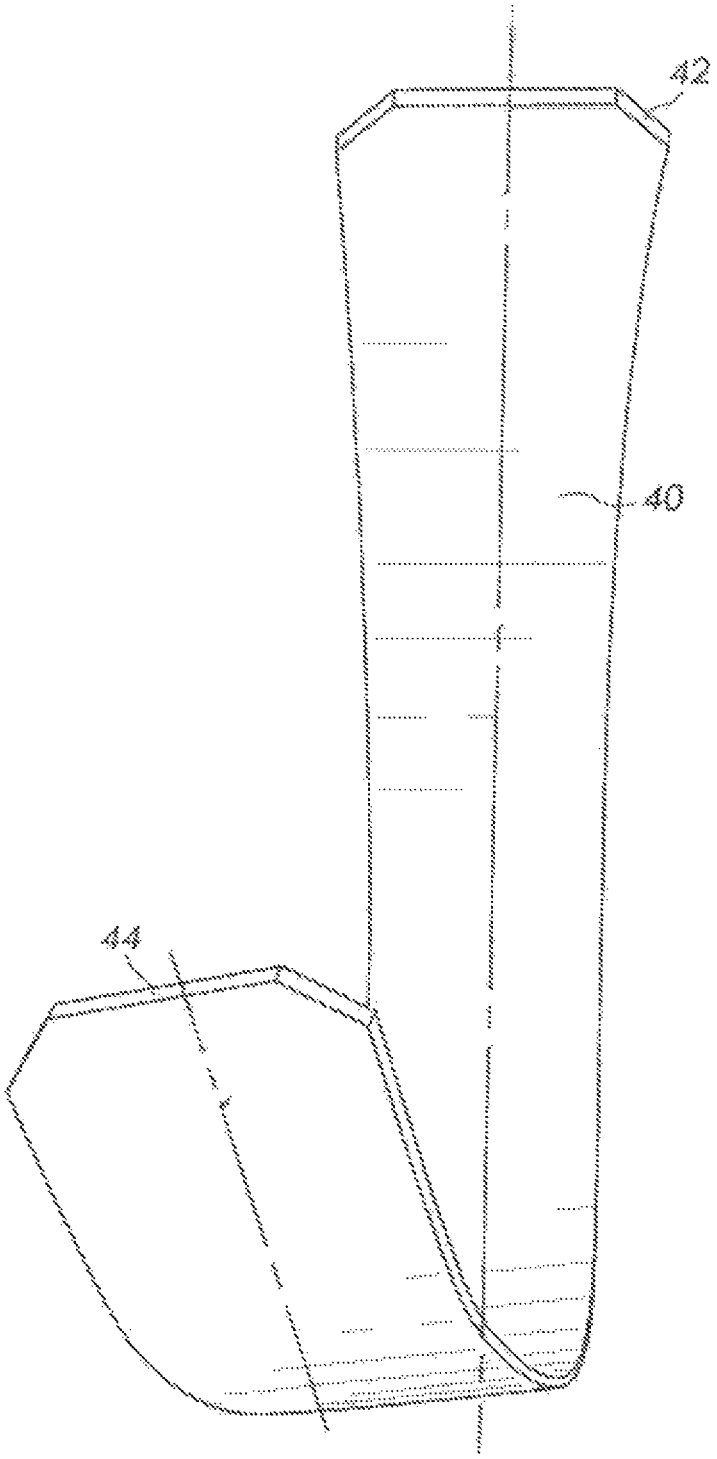
FIG. 4 is a perspective view of a twisted hook thereof.
Figure 5:
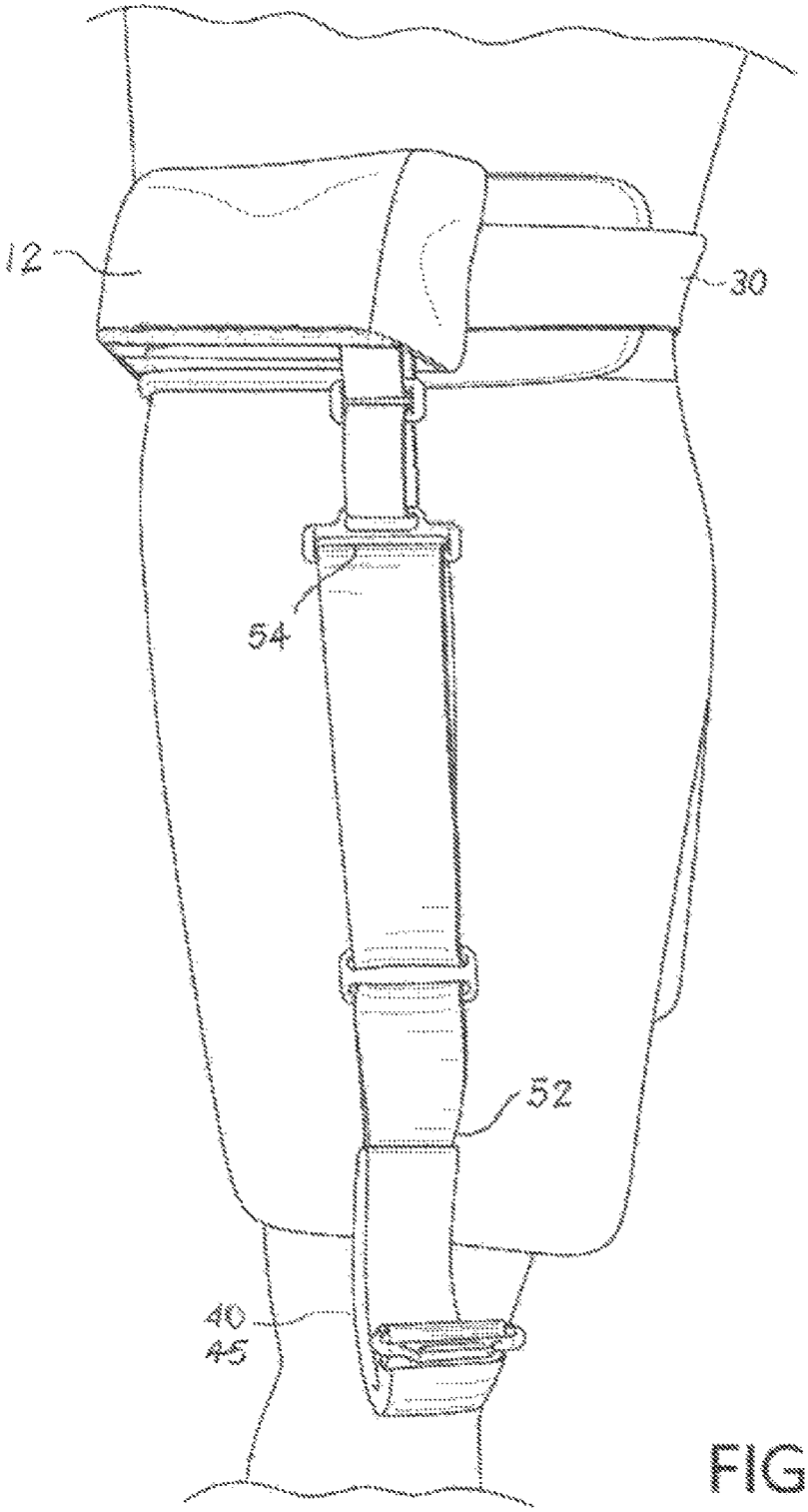
FIG. 5 is a perspective view of the belt and hook thereof as fully deployed.

Carrier 10 may also include a U-shaped hook ("hook 40") which may have a modified contour as shown in FIG. 3 wherein a proximal end 42 is spaced apart from a distal end 44 and ends 42 and 44 may be aligned laterally across hook 40, or they may be misaligned or mutually twisted as shown in FIG. 4. Both aligned and twisted versions of hook 40 provide for advantageous support of board 20. Hook 40 may have a width of up to about 5 inches so that it may provide a stable support surface for board 20 while also fitting neatly within hook bag 12. Hook 40 may be covered by a sleeve 46 (shown in FIGS. 1A and 6) of Cordura® material or equal and may have a neoprene or rubber insert sewn inside for cushioning as well as to increase sliding friction against board 20. Proximal end 42 may be joined to a proximal, length-adjustable strap 50 at a first end 52, while a second end 54 may be fixed within hook bag 12 by stitching, riveting, or by clamps, snaps, or other means. Hook 40 therefore may be positioned directly below hook bag 12 hanging by strap 50 as shown in FIGS. 1A and 5. Lower end 52 of strap 50 may be stiff and shaped as shown in FIG. 3 so as to force hook 40 away from the leg of the individual thus preventing mutual contact with the leg and hook 40 and making it easier to drop board 20 into hook 40. Depending on the location of hook bag 12, board 20 may be carried on the left side or on the right side of an individual. It is noted in FIG. 1A that board 20 is carried with its bottom surface 22 facing the individual carrying it. This is advantageous since the bottom surface 22 is either essentially flat or slightly concave; a reasonable fit against the side contour of an individual. Another advantage is that there is usually a hand-hold on the top surface 24 of board 20 within reach of the individual's hand so that placing an arm over board 20, as shown in FIG. 1A, and placing a hand in said hand hold can provide manual control of the attitude of board 20 especially when traversing a grade or stairs. A further advantage is that the fin or fins normally found on the bottom of board 20 are facing toward the individual carrying board 20 so there is less chance of an inadvertent contact of these relatively sharp fins with other individuals passing by as board 20 is carried to and from the water. Hook 40 may receive board 20 therein with no more than three-points of mutual contact between board 20 and hook 40 as shown in FIG. 3, i.e. points "A," "B," and "C." This is advantageous since with this three-point posture the weight of board 20 causes hook 40 to move away from the individual's leg. A distal, length-adjustable strap 60 may be attached at one end 62 to distal end 44 of hook 40 while a further end of strap 60, shown in FIG. 6 may be attached to belt 30 with adjustability in strap tension so that it is clear that distal, length-adjustable strap 60 may be lashed tightly over board 20 providing for hands-free carrying of board 20. In an embodiment, hook 40 may have an integral hinge 45 such as a "living hinge," for instance whereby tightening of distal strap 60 causes hook 40 to grip board 20.

Hook 40 is positionable over a vertical range of 24 inches by adjustments of length-adjustable straps 50 and 60 wherein this range of vertical adjustment enables carrier 10 to be used by both short as well as tall individuals. Straps 50 and 60 may be made of heavy duty dive/scuba belt webbing material and may be up to 3 inches in width providing lateral stability to board 20.

As shown in FIGS. 1A and 3, hook 40 may have attached thereto a spring clip 46 which may exert a strong clamping force on a paddle 25 to hold it in place in parallel attitude to paddleboard 20.

Hook 40 may be fabricated by bending metal strip material having a spring temper, or by injection-molding of a plastic or rubber or a combination compound so as to selectively provide for a spring flexibility. In this case proximal and distal ends of hook 40 may be flexibly-tensed apart when inserting board 20 so that compressive clamping forces are applied to board 20 to improve the holding power of hook 40 on board 20.

Figure 7A:
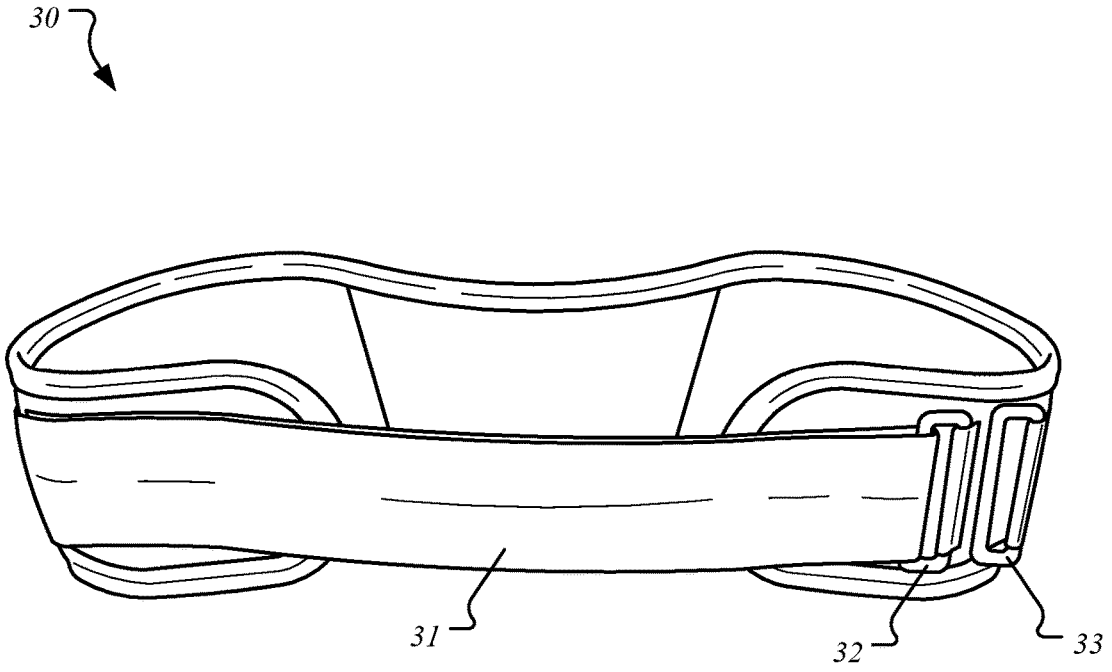
FIG. 7A is a front view of an alternate embodiment of a belt for use with the board carrier.

FIG. 7A depicts an alternate embodiment of belt 30, namely a front view, which may contain one or more attachment means for attaching various accessories for use with carrier 10. The various accessories which may be coupled to belt 30 in different configurations and locations around belt 30 allow for carrier 10 to serve as a full utility system as users/paddlers often find it desirable to carry certain items with them while paddling. In this view belt 30 is shown in a closed position via belt strap 31 and belt hook 32. Proximate to belt hook 32 is a first attachment means 33 (in this embodiment, which may be a belt hook similar or the same to belt hook 32) for attaching an accessory to carrier 10.

Figure 7B:
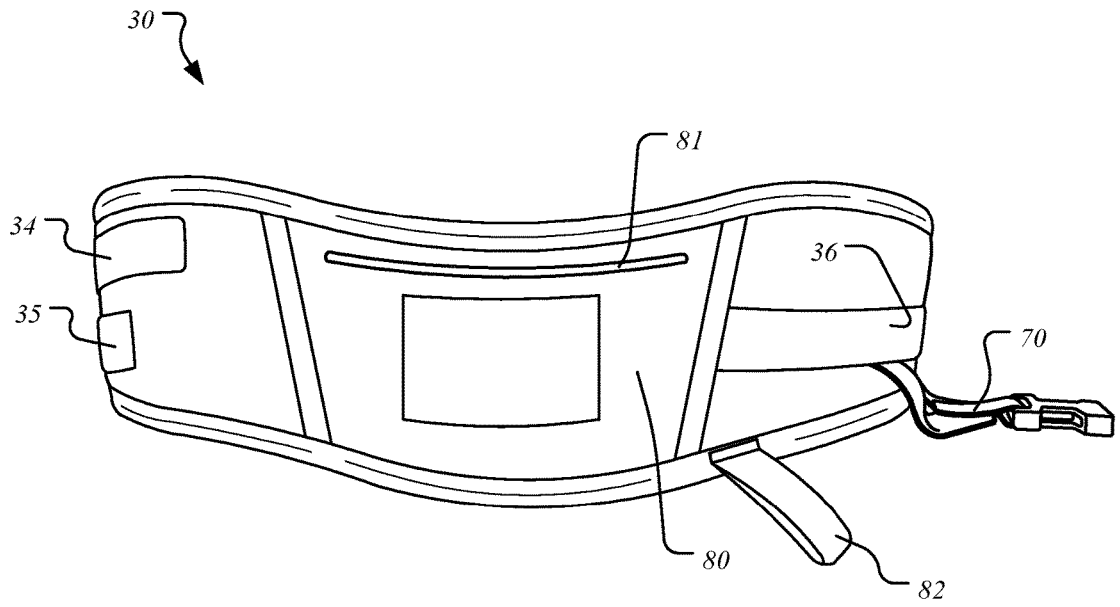
FIG. 7B is a rear view of the alternate embodiment of the belt.

FIG. 7B depicts the alternate embodiment of belt 30 and which depicts its rear view. In this view, second, third, and fourth attachment means 34, 35, and 36, respectively, are shown. In the belt 30 shown in this FIG. 7B, attachment means (34, 35, and 36) may be comprised of a hook and loop fastener (such as Velcro®), and may run along the sides of belt 30 in varying shapes and sizes. However, any of attachment means (33-36) may be comprised of quick release buckles, snaps, buttons, zippers, or D-ring cinch tabs with hook and loop fasteners, which may be attached to belt 30 in different positions to allow for optimal placement and fastening purposes of accessories with carrier 10. Attachment means 34 and 35 may be situated along one side of belt 30, such as the left side such as shown in FIG. 7B. Attachment means 36 may be situated along another side of belt 30, such as the right side as shown in FIG. 7B. Attachment means 36 may be situated behind a V-shaped strap 70 (also see FIG. 9), alongside it, or above it as also shown in this figure. Accessories such as gear bags (including waterproof bags), phone bags/cases, fish and tackle bags, rescue items (such as throw rope bags), hydration systems, water bladders (or CamelBak® inserts), waterproof Bluetooth® speaker bags, paddle clips, and personal flotation devices ("PFD"), and quick release leash attachments may be attached to and/or interchanged on belt 30. A user may attach such accessories around the front side of belt 30, or around the back side of belt 30, except that a PFD may need to be attached around the front of belt 30 according to current U.S. Coast Guard guidelines.

FIG. 7B also depicts pouch 80, which may be slim in size and may encompass the entire back facing portion of belt 30. Pouch 80 may be used to store personal items, such as I.D.s, credit cards, cash, and keys, or other items such as small sized Bluetooth® speakers, or an insertable GoPro® action camera mount that may be fastened within pouch 80 via clamps, fasteners, or clips. Pouch 80 may be comprised of a pouch opening 81, which may be comprised of a zipper, hook and loop fastener, snaps, or other similar fastening mechanisms. A hook loop 82 may be attached adjacent to pouch 80 on belt 30, which may hold hook 40 when it is not in use. Hook loop 82 may be positioned in other areas of belt 30, such as on an outer portion of pouch 80, in which hook loop 82 may be fastened on both of its ends to pouch 80, and hold hook 40 therein when hook 40 is not in use.

Figure 8A:
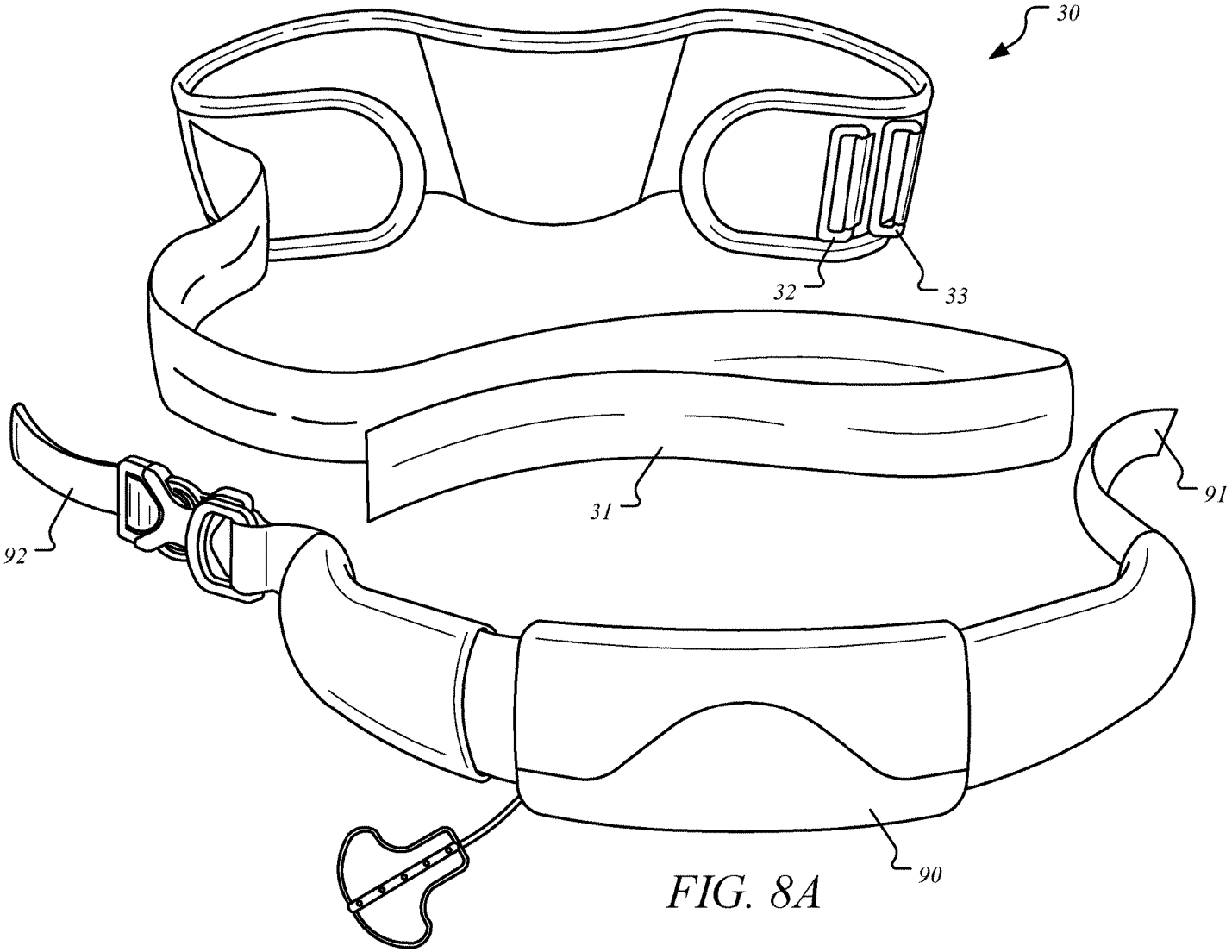
FIG. 8A is a front perspective view of the alternate embodiment of a board carrier and an accessory attachment.

FIG. 8A is a front view of belt 30 in an open position along with a PFD 90, which may be attached to the front side of belt 30 as discussed earlier with respect to FIG. 7B. PFD 90 may be further comprised of first and second ends 91 and 92, respectively, where first end 91 may attach to attachment means 34 and/or 35, and where second end 92 may attach to attachment means 36. First and second ends 91 and 92 may be comprised of a hook and loop fastener located on an inner side of ends 91 and 92 that may attach to attachment means 34, 35, and 36.

Figure 8B:
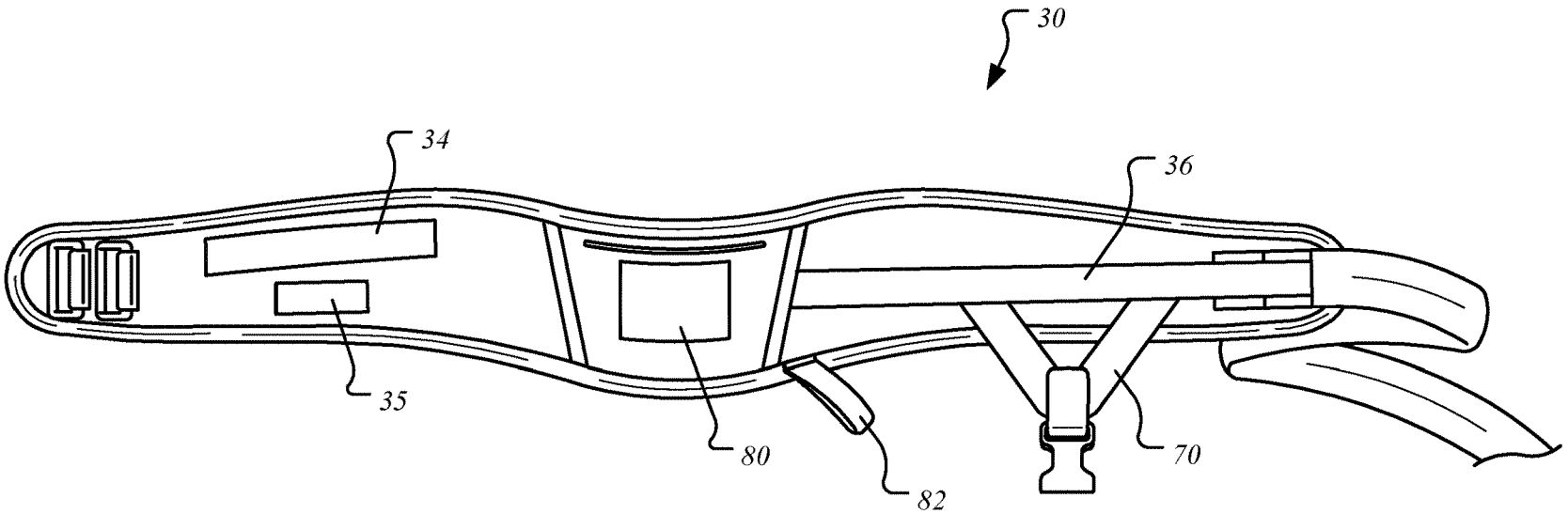
FIG. 8B is a rear view of the alternate embodiment of the board carrier.

FIG. 8B depicts a view of belt 30 in a general layout position. In this view, the positioning of attachment means 34, 35, and 36 are further depicted. However, attachment means 34, 35, and 36 may be positioned along different horizontal (or vertical) axes of belt 30 or in differing sizes, or types of attachment means (as explained earlier).

Figure 9:
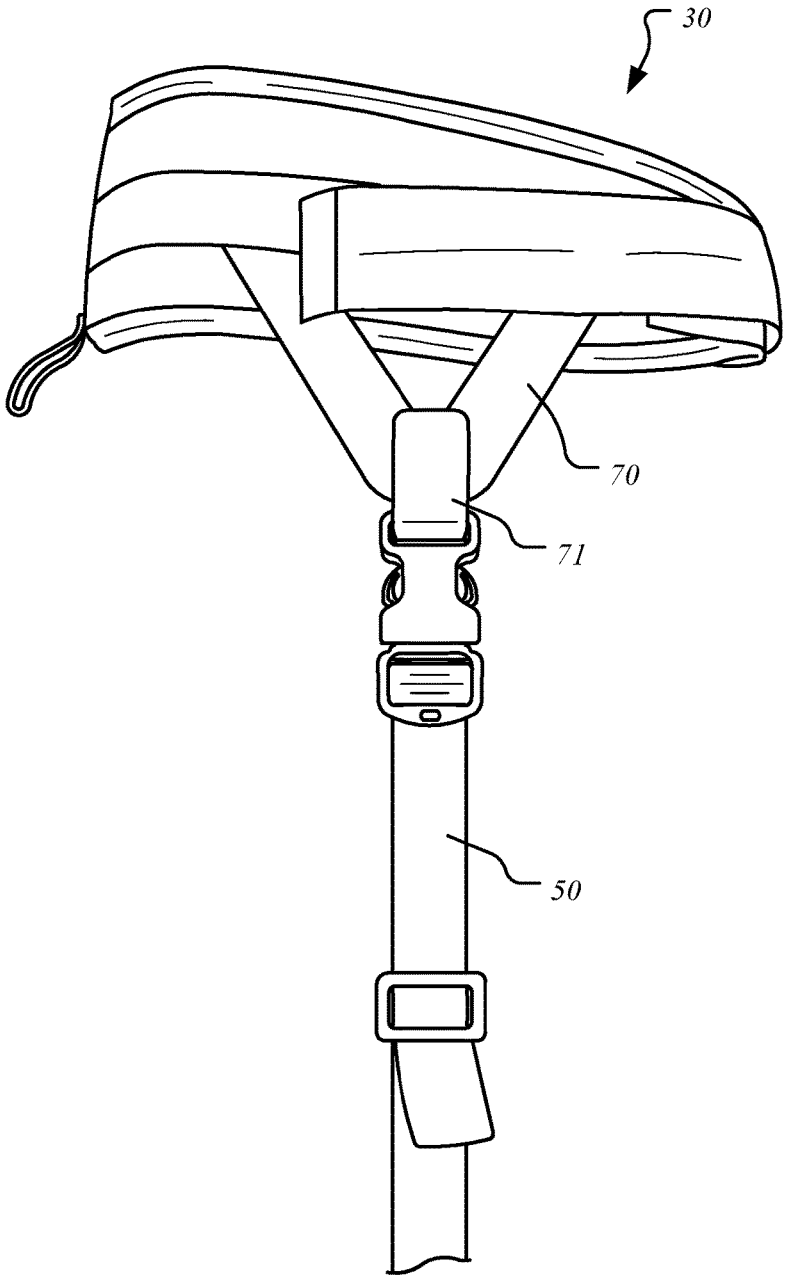
FIG. 9 is a front view of a V-shaped strap of the alternate embodiment of the board carrier.

FIG. 9 depicts a front view of V-shaped strap 70 of belt 30. In this embodiment of belt 30, strap 50 may be attached to belt 30 via V-shaped strap 70 instead of directly to a side of belt 30. V-shaped strap 70 may allow for enhanced weight distribution around belt 30 (and a user) when a board 20 is held within hook 40. Such enhanced weight distribution may allow for the weight of board 20 to be spread more evenly across a user's body rather than concentrated at one point or area so that the weight of board 20 is displaced toward the front and back of a user instead of vertically along a user's body side.

V-shaped strap 70 may be comprised of three points of attachment, namely, a first, second, and third point. Further, V-shaped strap 70 may be comprised of a fabric material, such as nylon webbing strap material, or other comparable and sturdy fabrics which may withstand a substantial amount of weight and/or force. V-shaped strap 70 may be coupled or attached to strap 50 via a connector piece 71, which may be comprised of a fabric similar to V-shaped strap 70, or may be a metal or plastic clip, hook, or other similar mechanism which allows for strap 50 to be securely fastened to V-shaped strap 70. In another embodiment, V-shaped strap 70 may be attached at one of more points to secondary belt piece (not shown) that may be integrated around the outer body of belt 30. Such secondary belt piece may provide for enhanced shock absorption and/or enhanced weight distribution around belt 30 as the entirety of belt 30 may be engaged to hold the weight of board 20. Secondary belt piece may be comprised of nylon webbing or urethane extruded material, and may be enclosed under a fabric piece sewn or attached around belt 30 with openings sufficient to connect to one or more points of V-shaped strap 70.

Figure 10:
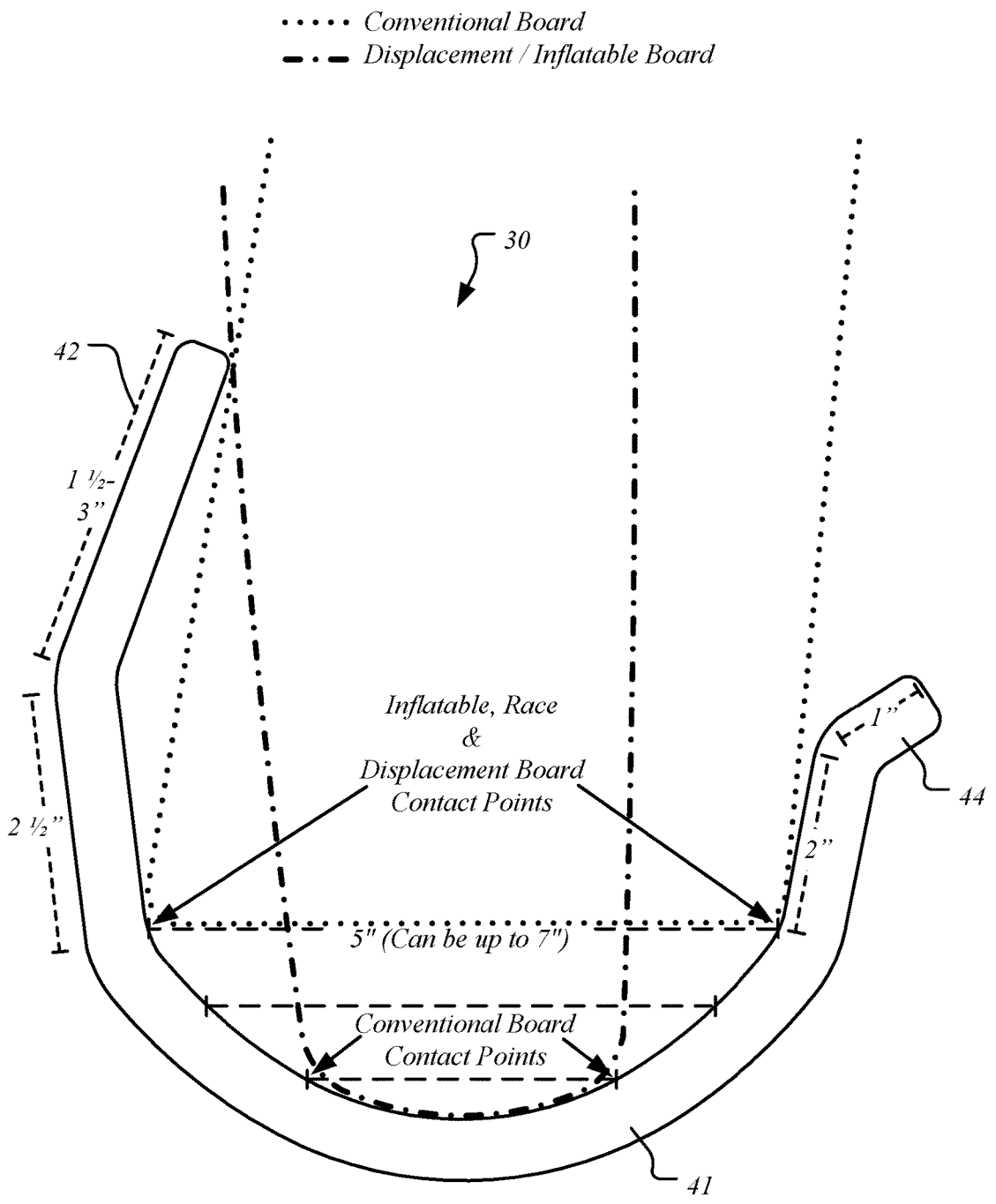
FIG. 10 is a side view of an alternate embodiment of a hook for use with the board carrier.

FIG. 10 depicts a side view of an alternate embodiment of hook 40. In this embodiment, hook 40 may be configured as a universal hook in which multiple sizes and styles of boards may be placed therein, and avoiding the need of a user to change the size of hook 40 when utilizing different types of board with carrier 10. For example, conventional, displacement, inflatable, and race boards may fit within such embodiment of hook 40 without the need to change the type/size of hook 40 that is coupled to belt 30. Proximal end 42 of hook 40 may be bent inward or curved inwardly, such as at an angle shown in FIG. 10, and proximal end 42 may make contact with a bottom portion of board 20, which may maintain board 20 in a generally vertical position as well as may prevent board 20 from rolling over hook 40, or to the side, or otherwise flailing in nature. Distal end 44 of hook 40 may be slightly bent or curved outwardly, such as at an angle shown in FIG. 10. Such bend or curvature may allow board 20 to easily slide within hook 40, which may eliminate or decrease the potential for board 20 to be placed incorrectly, or become stuck on distal end 44 when a user is placing board 20 there within.

Such bend or curvature of distal end 44 may also act as a visual point for a user when sliding or placing board 20 within hook 40, and which may allow user to ensure or verify that board 20 has been adequately placed therein. If a user cannot see or view distal end 44, then a user has the option to reassess whether board 20 has been placed within hook 40 or whether it may potentially fall out.

As shown in FIG. 10, a cradle area 41 of hook 40 may hold one end or side of board 20, when board 20 is placed therein. In this embodiment of hook 40, cradle area 41 may be approximately 5 inches in width or up to approximately 7 inches in width, in order to accommodate the placement of varying size and types of boards in addition to conventional sized boards. Further in this embodiment, the proximal end 42 and distal end 44 of hook 40 may be comprised of measurements as those shown in FIG. 10. Proximal end 42 may have measurements from 1.5-3 inches in length along an upper portion of its curved or bent portion and may be 2.5 inches in length along a lower part of its curved or bent portion (See FIG. 10). Distal end 44 may have measurements of 1 inches along an upper portion of its curved or bent portion and may be 2 inches in length along a lower part of its curved or bent portion (See FIG. 10). The foregoing measurements may vary in length depending on materials, sizing requirements, and other factors that may need to be taken into account in order to fit and/or position board 20 within carrier 10 as is disclosed herein.

FIG. 10 also depicts where the points of contact may be for conventional type boards that is positioned within carrier 10. Similarly, FIG. 10 also depicts where the points of contact may be within hook 40 for inflatable, displacement, and race type boards. In this embodiment of hook 40, hook 40 may be further comprised of a clip 46 for carrying a paddle 25 (not shown), and which may integrated into hook 40 similar to that shown in FIG. 3.

Figure 11:
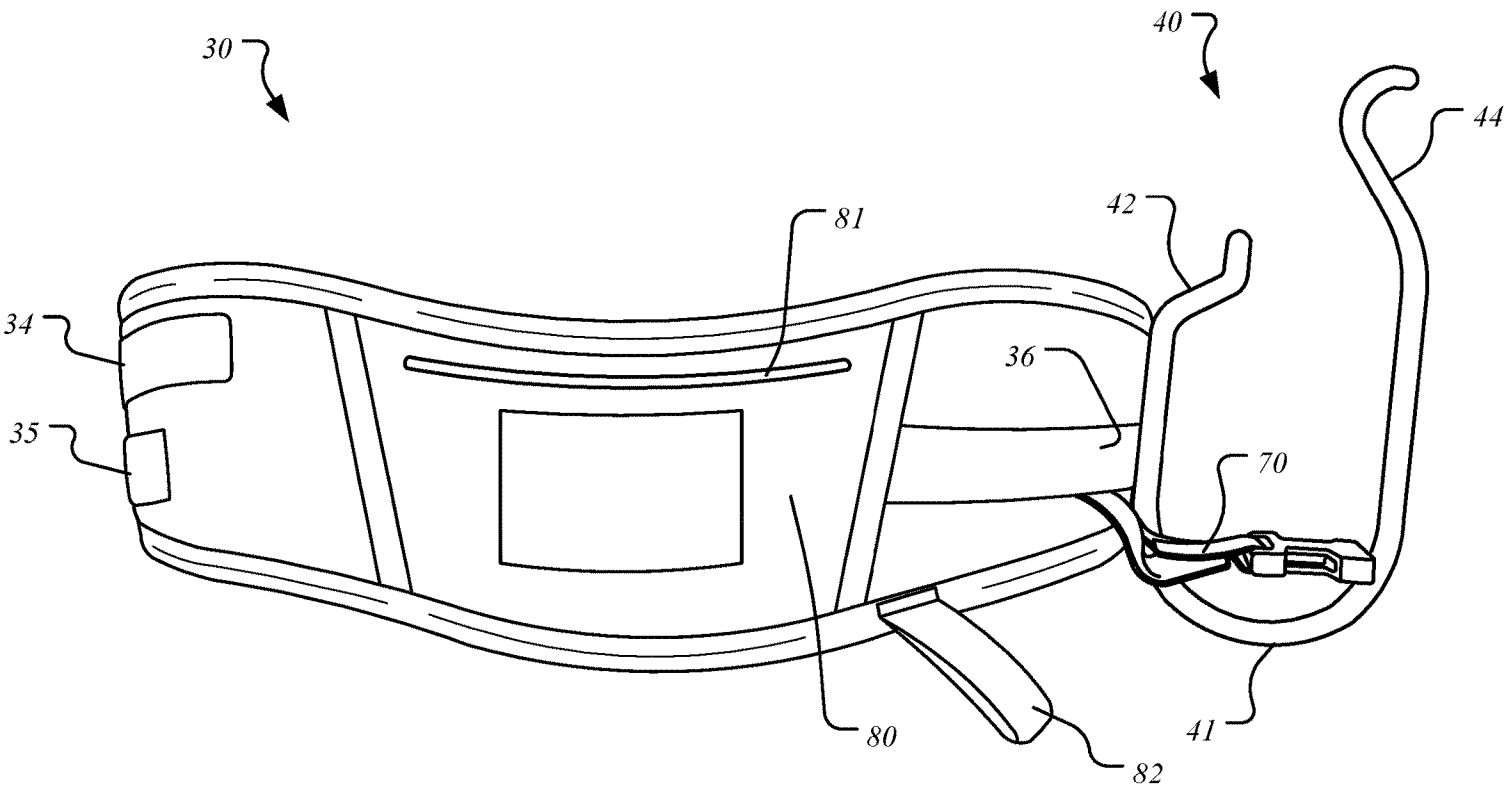
FIG. 11 is a side view of an alternate embodiment of hook for use with the board carrier.

FIG. 11 depicts another embodiment of hook 40, which may hold other types of boards, or sports items, such as ocean kayaks and other larger watercraft. As shown in this figure, hook 40 may be attached directly to belt 30 (fastening elements not shown in this view), and which may allow for a sturdier and stable positioning of a substantially larger and heavier item than board 20, such as an ocean kayak. This embodiment of hook 40 may be attached to belt 30 in different ways. For example, hook 40 may be covered with sleeve 46 with proximal end 42 of hook 40 configured with a quick release buckle connector (either male or female) and strap 50, which may be attached to V-shaped strap 70 via the quick release buckle connector (male or female). Additionally, proximal end 42 may be configured so that it curves outwardly and down along its length, so that such outwardly curved portion of proximal end 42 may be inserted into a pocket situated vertically along a side of belt 30, where pocket may have a hook and loop fastener situated there below the sleeve for purposes of stabilizing hook 40. Furthermore, hook 40 may be enclosed by sleeve 46, which has a quick release buckle connector (male or female) attached at a portion of sleeve 46 covering proximal end 42. Such quick release buckle may be attached to the corresponding quick release buckle connector (male or female) that may be attached at one side of belt 30. Once hook 40 is attached to belt 30 in this manner, hook 40 may be further secured to belt 30 via a cinch strap, which may be situated below the quick release buckle connector on belt 30.

Figure 6:
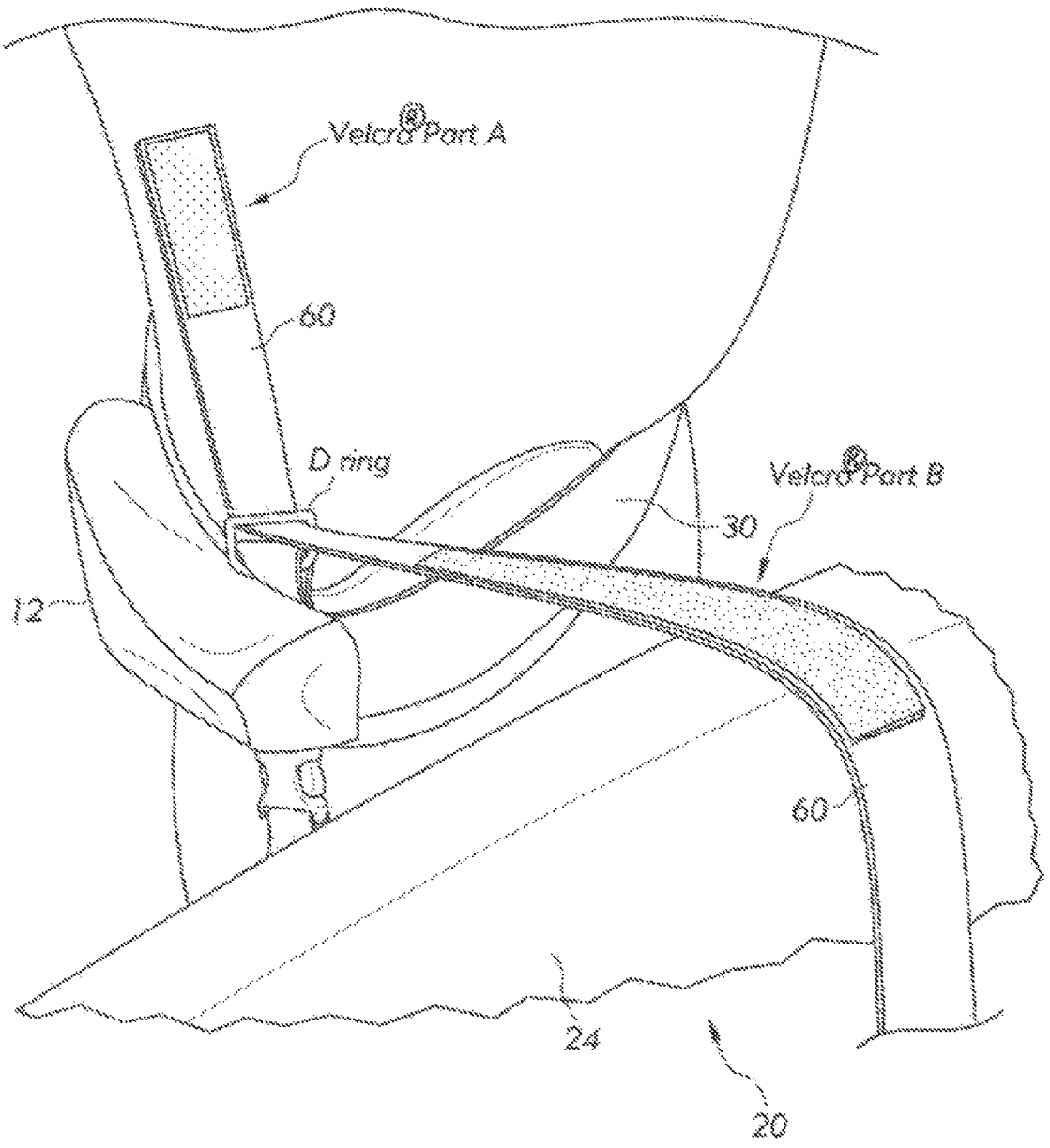
FIG. 6 is a perspective view of the distal strap as folded over the board and engaged through a ring of the belt in the process of being pulled tight.
Figure 12:
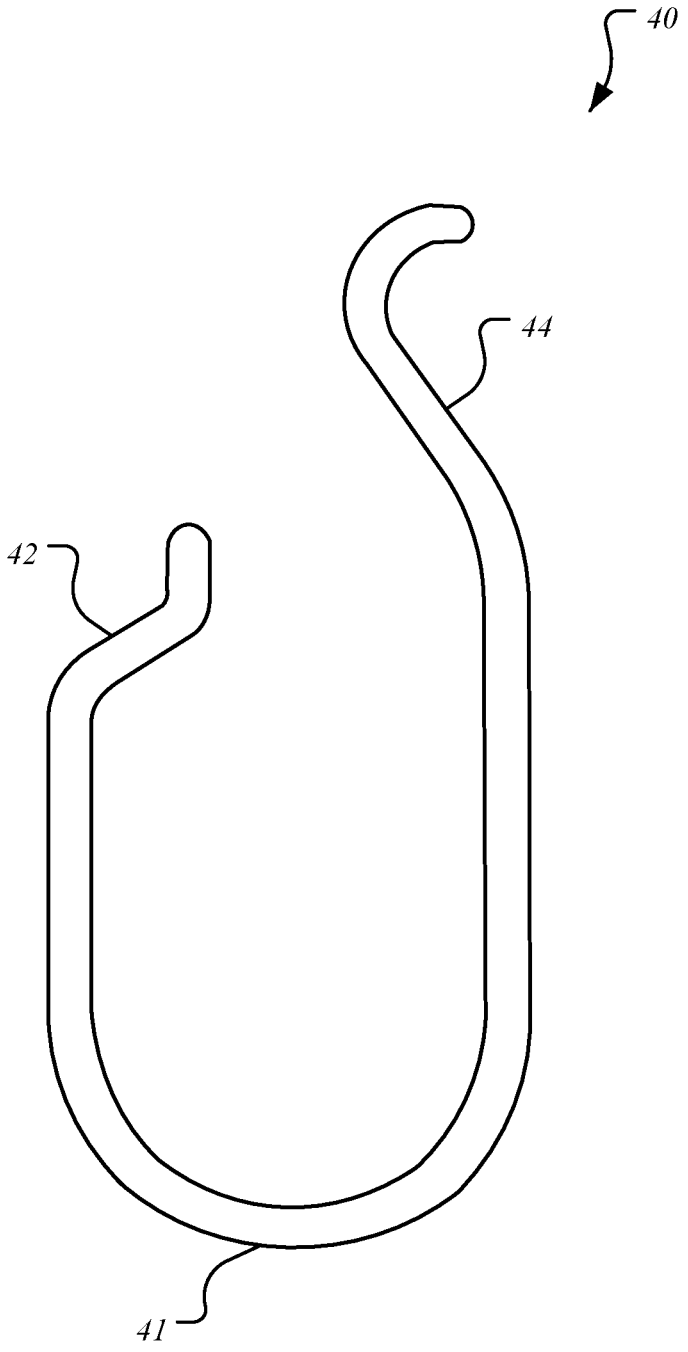
FIG. 12 is a side view of the alternate hook embodiment.

FIG. 12 depicts a side view of the alternate embodiment of hook 40, including cradle area 41, proximal end 42, and distal end 44. When in use, a kayak (not shown) may be positioned so that a cockpit of kayak is facing the user, and user may then place the cockpit's upper edge upon distal end 44 so that the cockpit rests within cradle area 41 of hook 40. In this position, distal end 44 will have contact with an upper wall of the inside of cockpit, and proximal end 42 may contact an outside sidewall of cockpit. A distal length adjustable strap 60 (as shown in FIG. 6) may be utilized in a similar manner to hold kayak in place over this embodiment and placement of hook 40.

Various aspects of the present invention are described herein with reference to illustrations and/or diagrams according to embodiments of the invention. While particular forms of the invention have been illustrated and described, it will also be apparent to those skilled in the art that various modifications can be made without departing from the spirit and scope of the invention. Accordingly, it is not intended that the invention be limited except by the claims.

The invention claimed is:

1. A carrier for a board comprising:

a belt configured for wearing around a waist of a person, said belt having one or more points of attachment for a fastener mechanism situated on an outwardly facing side of said belt;

a board hook, comprising:

a first bend, a first length, a second length, and a third length;

a board receiving gap being defined by the first length, the first bend, and the second length;

the third length including a proximal portion attached to a length-adjustable strap with the opposite end of the length-adjustable strap attached to said belt via a V-shaped strap, and a second bend and a third bend formed between the proximal portion and the first bend;

the second bend and the third bend being curved such that a central portion of each the second bend and the third bend extend away from the first length;

the third length angling away from the third bend in a direction toward the first length; and said board hook configured for receiving said board therein with no more than three-points of mutual contact therebetween.

2. The carrier of claim 1, wherein said V-shaped strap is further comprised of a first, a second, and a third fastener mechanism points, where said first and second points are coupled to said belt and said third point is coupled to said length-adjustable strap.

3. The carrier of claim 1, wherein an accessory is coupled to said one or more fastener mechanism attachment points of said belt.

4. The carrier of claim 3, wherein said accessory may comprises a personal flotation device.

5. A combination board and carrier for said board, the combination comprising:

a belt configured for wearing around a waist of a person, said belt having one or more points of attachment for a fastener mechanism situated on an outwardly facing side of said belt;

a board hook, comprising:

a spiral bend, a first length, a second length, and a third length, said spiral bend angling the second length relative to the first length;

a board receiving gap being defined by the first length, the spiral bend, and the second length;

the third length including a proximal portion attached to a length-adjustable strap with the opposite end of the length-adjustable strap attached to said belt, and a second bend and a third bend formed between the proximal portion and the spiral bend;

the second bend and the third bend being curved such that a central portion of each of the second bend and the third bend extends away from the first length; and the third length angling away from the third bend in a direction toward the first length.

6. The carrier of claim 5 wherein said board hook is positionable over an adjustment range of 24 inches.

7. The carrier of claim 5 wherein said board hook further comprises a clip for attaching a paddle thereto.

8. The carrier of claim 5 wherein said board hook is of a spring temper flexible material.

9. The carrier of claim 8 wherein said first length, said second length, and said third length of said board hook are flexed apart when said board is received in said board hook, said first, second, and third lengths thereby exerting a compressive force on said board.

* * * * *